US011691153B2

(12) United States Patent
Hoogendoorn

(10) Patent No.: US 11,691,153 B2
(45) Date of Patent: Jul. 4, 2023

(54) IMPACT CRUSHER

(71) Applicant: KEESTRACK N.V., Munsterbilzen (BE)

(72) Inventor: Frederik Hoogendoorn, Bilzen (BE)

(73) Assignee: KEESTRACK N.V., Munsterbilzen (BE)

( * ) Notice: Subject to any disclaimer, the term of this patent is extended or adjusted under 35 U.S.C. 154(b) by 23 days.

(21) Appl. No.: 16/609,134

(22) PCT Filed: May 17, 2018

(86) PCT No.: PCT/EP2018/062982
§ 371 (c)(1),
(2) Date: Oct. 28, 2019

(87) PCT Pub. No.: WO2018/211029
PCT Pub. Date: Nov. 22, 2018

(65) Prior Publication Data

US 2020/0094258 A1 Mar. 26, 2020

(30) Foreign Application Priority Data

May 17, 2017 (DE) ..... 10 2017 110 758.4

(51) Int. Cl.
*B02C 13/09* (2006.01)
*B02C 13/282* (2006.01)
*B02C 21/02* (2006.01)

(52) U.S. Cl.
CPC ..... *B02C 13/095* (2013.01); *B02C 13/282* (2013.01); *B02C 21/02* (2013.01)

(58) Field of Classification Search
CPC ..... B02C 13/095; B02C 13/282; B02C 21/02; B02C 21/026
(Continued)

(56) References Cited

U.S. PATENT DOCUMENTS 2,411,302 A * 11/1946 Stine ..... B02C 13/282 241/88.3
2,471,068 A * 5/1949 Keiper ..... B02C 13/282 241/88.2
(Continued)

FOREIGN PATENT DOCUMENTS

CH 521 792 6/1972
CN 103084238 A 5/2013
(Continued)

OTHER PUBLICATIONS

English translate (DE2015763A1), retrieved date Apr. 18, 2021.*
(Continued)

*Primary Examiner* — Shelley M Self
*Assistant Examiner* — Mohammed S. Alawadi
(74) *Attorney, Agent, or Firm* — Henry M. Feiereisen LLC

(57) ABSTRACT

An impact crusher for mineral material includes a crusher housing, a reversible rotor arranged in an impact-grinding space of an impact mechanism for propelling mineral material against wear members in the crusher housing; and an adjustment installation setting a spacing of the impact mechanism from the rotor. An upper impact space adjoins the impact-grinding space at the top and has an entry opening for the mineral material. The upper impact space has an upper height region that neighbors the entry opening, a central height region that adjoins the upper height region, and a lower height region that is contiguous to the lower impact-grinding space, with the central height region being a region having a largest internal width and at a widest location thereof, which is above a crushing circle of the rotor, has a maximum width which is larger than a diameter of the crushing circle of the rotor.

8 Claims, 4 Drawing Sheets

(58) Field of Classification Search
USPC ..... 241/286
See application file for complete search history.

(56) References Cited

U.S. PATENT DOCUMENTS

| | | | | | |
|---|---|---|---|---|---|
| 4,009,836 | A | | 3/1977 | Strom et al. | |
| 4,635,863 | A | | 1/1987 | McCorkel | |
| 5,062,575 | A | * | 11/1991 | Barnabie | B02C 13/282 241/73 |
| 5,125,585 | A | | 6/1992 | Williams | |
| 5,435,050 | A | * | 7/1995 | Alt | B02C 13/282 29/402.03 |
| 7,229,041 | B2 | * | 6/2007 | Cohen | B02C 13/09 241/189.1 |
| 2006/0086850 | A1 | | 4/2006 | Cohen et al. | |

FOREIGN PATENT DOCUMENTS

| | | | | | |
|---|---|---|---|---|---|
| CN | 203565137 | | | 4/2014 | |
| CN | 104668033 | | | 6/2015 | |
| CN | 104668033 | A | | 6/2015 | |
| DE | 967 697 | | | 12/1957 | |
| DE | 2015763 | A1 | * | 10/1970 | B02C 13/286 |
| DE | 29 06 303 | | | 8/1980 | |
| JP | H 05-168962 | | | 7/1993 | |
| JP | H06-24748 | | | 4/1994 | |
| JP | H 07251084 | A | | 10/1995 | |
| JP | 2003038968 | A | | 2/2003 | |
| JP | 20030388968 | A | | 2/2003 | |
| JP | 2003093903 | A | * | 4/2003 | |
| JP | 3622116 | B2 | | 2/2005 | |
| JP | 3849033 | B2 | | 11/2006 | |
| JP | 2007-083101 | | | 4/2007 | |
| KR | 20160050986 | A | | 5/2016 | |

OTHER PUBLICATIONS

English translate (JP2003093903A), retrieved date Sep. 15, 2021.*
Chinese Search Report dated Nov. 2, 2020 with respect to counterpart Chinese patent application 2018800324308.
Translation of Chinese Search Report dated Nov. 2, 2020 with respect to counterpart Chinese patent application 2018800324308.
International Search Report issued by the European Patent Office in International Application PCT/EP2018/062982 dated Jun. 20, 2018.
Chinese Search Report dated Jun. 9, 2021 with respect to counterpart Chinese patent application 2018800324308.
Translation of Chinese Search Report dated Jun. 9, 2021 with respect to counterpart Chinese patent application 2018800324308.

* cited by examiner

A-A

A-A

IMPACT CRUSHER

CROSS-REFERENCES TO RELATED APPLICATIONS

This application is the U.S. National Stage of International Application No. PCT/EP2018/062982, filed May 17, 2018, which designated the United States and has been published as International Publication No. WO 2018/211029 and which claims the priority of German Patent Application, Serial No. 10 2017 110 758.4, filed May 17, 2017, pursuant to 35 U.S.C. 119(a)-(d).

BACKGROUND OF THE INVENTION

The invention relates to an impact crusher.

Impact crushers are used for comminuting mineral materials (natural rock or recycling material) and for producing fine or coarse aggregate. Mineral materials are comminuted in multiple successive crusher stages for producing fine or coarse aggregate such as, for example, double-crushed chips. Larger lumps are first comminuted in a jaw crusher as the primary crusher stage, then transferred to a cone crusher as a secondary crusher stage, and thereafter are fed to a, for example, as a tertiary crusher stage. Taking into account the severe wear in the crushers as well as the high economic investment for the procurement and the operation of three individual crushers, there is the desire to combine the secondary and tertiary crusher stages. This assumes in the first place that a comparatively coarse fraction can be crushed to a sufficiently fine aggregate in the remaining secondary crusher stage as the last crusher stage. Coarse and fine proportions can impede each other in an impact crusher and mitigate the impact energy. Therefore, the results are not always optimal in the case of widely different fractions to be processed. Adapting the geometry of the crusher to widely different fractions is possible only to a limited extent. A further problem is that comparatively large mineral proportions for an effective comminution also require a larger impact space and an initially wide crusher gap. When the impact space is conceived for comparatively small material the infeed of comparatively large material can clog the crusher.

Impact crushers having a horizontal or vertical rotor as the last crusher stage of the processing chain are known in the prior art. The impact crushers as the last crusher stage are conceived so as to be able to receive only a relatively small, pre-produced material.

Proceeding therefrom, the invention is based on the object of refining an impact crusher with a view to said impact crusher better processing an input material having widely different aggregates and to in particular being adaptable to different fractions, and to the possibility of a secondary and tertiary crusher stage being combined so as to form a single crusher stage being provided on account thereof.

SUMMARY OF THE INVENTION

This object is achieved by a crusher including a crusher housing a reversible rotor having a horizontal rotation axis, for propelling mineral material against wear members in the crusher housing, a drive for driving the rotor, an impact-grinding space which is delimited by at least one impact mechanism that is adjustable relative to the crusher housing and relative to the rotor, wherein the rotor is arranged in the impact-grinding space; at least one adjustment installation for setting the spacing of the impact mechanism from the rotor, an upper impact space, adjoining the impact-grinding space at the top, having an entry opening for the mineral material to be comminuted, wherein the upper impact space has an upper height region that neighbors the entry opening, a central height region that adjoins the upper height region, and a lower height region that is contiguous to the lower impact-grinding space, wherein each height region possesses in each case one horizontally measured internal width, wherein the central height region is the region having the largest internal width and at the widest location thereof, which is above the crushing circle of the rotor, has a maximum width which is lager than the diameter of the crushing circle of the rotor.

The dependent claims relate to advantageous refinements of the invention.

The impact crusher according to the invention for mineral material such as natural rock or recycling material, possesses a crusher housing having a single rotor having a horizontal rotation axis. The rotor is reversible. Said rotor can be operated in both rotation directions. The rotor is populated with impact strips which propel charged material against wear members in the crusher housing. The material breaks into smaller pieces on account of the impact. The regions of the crusher housing against which the material to be crushed is propelled are equipped with wear members.

The crusher housing is simultaneously the supporting frame for the impact crusher. Said crusher housing comprises bearings for the rotor which is driven by a drive. The drive is preferably situated outside the crusher housing. The drive can be an internal combustion engine or else an electric drive. Depending on the drive mode, suitable energy sources can be assigned to the drive.

The space within the crusher housing that is surrounded by the wear members is referred to as the impact space. The impact space in the case of the invention is divided into two regions, specifically an upper impact space and a impact-grinding space that is disposed below the upper impact space. The impact-grinding space is delimited by an adjustable impact mechanism. The spacing between the crushing circle of the rotor and the wear members of the impact mechanism, that is to say the crushing gap, can be set by means of the impact mechanism, and the fineness of the final product can thus be varied. The adjustment is performed by way of an adjustment installation. This herein can be a purely mechanical, a hydro-mechanical, or an electro-mechanical spindle drive which repositions an impact arm of the impact mechanism, having the wear members disposed on said impact arm, relative to the crusher housing.

The contour of the impact chamber has a substantial influence on the fineness of the final product. The material flow from material to be processed makes its way by way of an entry opening at the upper end of the impact chamber to the rotor which is situated at a spacing from the entry opening and vertically below the entry opening. The charged material impacts the rotor from above, that is to say in a radial manner, and by an impact strip of the rotor is propelled against the wear members of the upper impact chamber where the material breaks, bounces, and potentially hits further wear members.

The upper impact chamber is divided into three height portions: an upper, a central, and a lower height portion. The upper height portion forms the termination of the upper impact chamber at the top and delimits the entry opening. The impact chamber in relation to the width of the entry opening becomes rapidly larger in the upper height portion. The upper height portion can therefore also be referred to as the upper side of the impact chamber. The contour of the impact chamber on this upper side is preferably almost horizontal.

The central height portion of the upper impact chamber adjoins here. Said central height portion possesses the largest width of all height portions mentioned. The central height portion is designed so as to be concave. This does not mean that said central height portion has to be rounded in a transition-free manner. The concave design can also be a sequence of segments which is significantly determined by the shape and the orientation of the wear members. The contour of the impact chamber is preferably separated, so as to correspond to the shape and the disposal of the wear members, such that there are many crushing edges for the impacting materials.

The lower height region of the upper impact space terminates at a crushing edge. The lower impact-grinding space simultaneously starts here. The lower height region serves as an inlet funnel for the impact-grinding space. As opposed to the concave central height region which has the largest differences in terms of width, the reduction in the width is less in the lower height region. The lower height region preferably does not extend beyond the upper edge of the crushing circle but is situated in the upper half of the rotor or the crushing circle, respectively. The crushing edge, that is to say the lower end of the inlet funnel of the crushing gap that is delimited by the lower height region, and thus the upper end of the impact-grinding space, is preferably also situated there.

An upper region of the rotor, or of the crushing circle thereof, respectively, protrudes upward beyond the crushing edge in the direction toward the entry opening and thus into the lower height region of the upper impact space, preferably even completely penetrating the latter. The region of the largest lateral (internal) width of the entire impact space in the case of the invention is situated above the crushing circle of the rotor. A very wide and large impact space is provided above the rotor, this enabling the material to be comminuted to move more freely upon initial contact with the impact strip, or on the way back from the wear members of the impact flanks toward the rotor. Fewer mutual impediments and thus a reduced mitigation of the impact energy arises on account of the wide impact space. The crushing result is significantly better even in the case of materials that differ widely in terms of size.

The impact crusher is reversible, that is to say that the single rotor can be operated in both rotation directions. A more uniform wear can be achieved on account thereof. The intervals for changing the wear members are extended. For a consistent comminution result, independently of the rotation direction of the rotor, the impact space is configured so as to be symmetrical in relation to a central vertical plane of the impact crusher, that is to say so as to be concave on both sides according to the invention. The symmetrical configuration refers to the fundamental design of the impact crusher, also referred to as a reversing impact crusher, having a centrical material infeed on the upper side.

In the context of the invention, the width of the upper impact space at the widest location of the central height region there is larger than the diameter of the crushing circle of the rotor. The region which is swept by the impact means, in particular by the impact strip of the rotor during the rotation of the rotor is referred to as the crushing circle.

Said width of the widest location of the central height region is not only larger than the crushing circle of the rotor but also larger than the maximum width of the impact-grinding space, said maximum width being situated approximately at the height level of the rotation axis of the rotor. The impact space at the widest location thereof in the central height region is always, that is to say in the case of each crushing gap set, wider than the crushing circle and the impact-grinding space by a positive dimension X.

A further advantage of the invention, specifically the adaptability to materials of different sizes, is achieved in that the width of the entry opening is variable by adjusting the width of the impact space. Commercially available reversible impact crushers do not possess any possibility for adapting to the charge size of the fraction be comminuted. Said commercially available reversible impact crushers do not have any variable impact space designed between the inlet and the rotor which enable a free movement of the fraction be comminuted upon initial contact with the impact strip on the rotor, or on the way back from the impact arms to the rotor, without the crushed material excessively impeding itself and mitigating the applied impact energy.

The entry opening into the impact space is located centrically above the upper height region of the upper impact space. The entry opening per se can be configured in the manner of a duct, wherein the width of the duct of the entry opening is adjustable. The width of the entry opening is preferably smaller than the diameter of the crushing circle.

The impact arms can have an upper mounting point ((rotation point) in the proximity of the entry opening. When an impact arm is pivoted about said mounting point, the width of the duct of the entry opening is also varied very slightly in the sense that the duct, depending on the position of the rotation point, becomes wider in a first portion and narrower in another portion, as is the case with a rocker. In the context of the invention, at least one wall of an entry opening is displaced in a linear and thus overall manner. Said wall, in addition to the linear repositioning thereof, can simultaneously be pivoted such that two types of movement are superimposed. The linear repositioning enables the entry opening in terms of the width thereof be varied more intensely and uniformly than the pure pivoting about a bearing point that is disposed close to the entry opening.

The linear displacement is performed by the adjustment of the impact arms of the impact mechanism. The impact arms support the wear members. The impact arms at least in terms of the disposal of the wear-protection elements, preferably overall, are configured so as to be mirror-symmetrical in relation to the central vertical plane of the impact crusher. Since said impact arms are adjustable, said impact arms are capable of being disposed in a mirror-symmetrical manner as well as in a non-mirror-symmetrical manner. The impact arms in the vertical direction extend beyond both impact spaces. This means that there are no separate impact arms only for the upper impact space and only for the lower impact-grinding space, but common impact arms for both spaces so that the width of the impact-grinding space is adjustable only conjointly with the width of the upper impact space. On account thereof, it is possible for the width of the entry opening as well as the width of the crushing gap in the impact-grinding space to be set by way of a minor number of actuator devices.

During the operation, the desired crushing gap is set only on one side of the rotor, while the impact arm on the other side of the rotor is situated in an open position (parking position). This reduces the wear on the parked impact arm. When the rotation direction is reversed, the previously parked impact arm is set to the desired crushing gap, and the other impact arm is opened.

The crushing edge is situated in the transition from the impact-grinding space to the upper impact space. Said crushing edge is to some extent a region in which the intense reduction of the width from the central height region emanating from the upper impact space no longer continues but is stopped, in the further profile toward the lower impact-grinding space is reversed or is continued so as to reduce only very slowly. On account thereof, a kink or a more intense curvature is created in the contour. The internal contour of the two impact walls can in particular correspond to the substantially rounded the contour of the letter "B", or of a mirrored letter "B", respectively. It is not mandatory for a heavily pronounced crushing edge be situated between the concave arcs. The arcs in the impact space and in the lower impact-grinding space can also be of dissimilar widths. The arcs can moreover extend across dissimilar heights.

All necessary positions of the impact arms can be set by means of adjustment installations. Each impact arm possesses an adjustment installation. Each adjustment installation possesses an upper impact arm adjustment and a lower impact arm adjustment. The upper impact arm adjustment serves for adapting the width of the impact-grinding space and for adapting the width of the entry opening to a maximum charge size of the material to be comminuted. The lower impact arm adjustment serves for adapting the crushing gap, that is to say the spacing of the wear members in the impact-grinding space, to a crushing circle of the rotor. The adjustment preferably takes place by way of spindle drives which are driven in a purely mechanical, electrical, or hydraulic manner and displace an upper and lower bearing point of the impact arms transversely to the rotor. Gate guides for the bearing points, in particular in the form of elongate holes, enable individual symmetrical or else non-symmetrical positioning of the impact arms by linear displacement.

The impact crusher according to the invention can be used in a stationary or mobile manner. Apart from the drive and a control system (not explained in more detail), an infeed installation for the mineral material to be comminuted to the entry opening and an outfeed installation for outfeeding comminuted mineral material from the exit opening to a drop-off end of the outfeed installation are required for the operation of the impact crusher. A frame on which the impact crusher housing, the infeed installation, the outfeed installation, and the drive are disposed is preferably provided.

A running gear for mobility for the non-stationary use can be disposed on the frame. The running gear is a tracked running gear or a wheel running gear which enables the impact crusher to negotiate a construction site or a quarry, for example. The drive of the impact crusher mentioned above can also drive the running gear by way of auxiliary motors.

BRIEF DESCRIPTION OF THE DRAWING

The invention will be explained in more detail hereunder by means of an exemplary embodiment that is illustrated in the drawings in which.

DETAILED DESCRIPTION OF PREFERRED EMBODIMENTS

Figure 1:
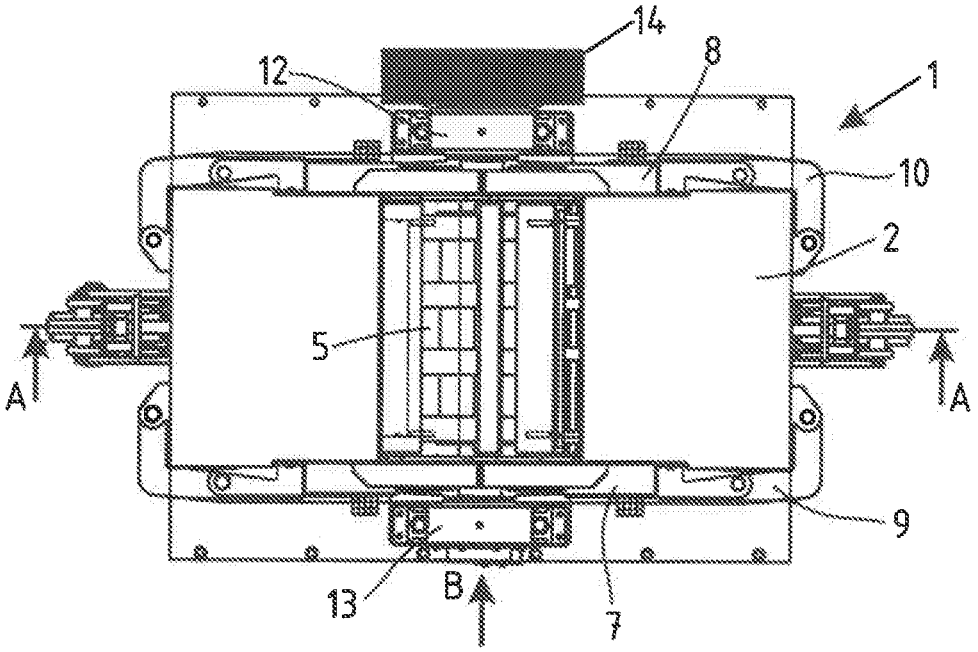
FIG. 1 shows an impact crusher in a view from above.
Figure 2:
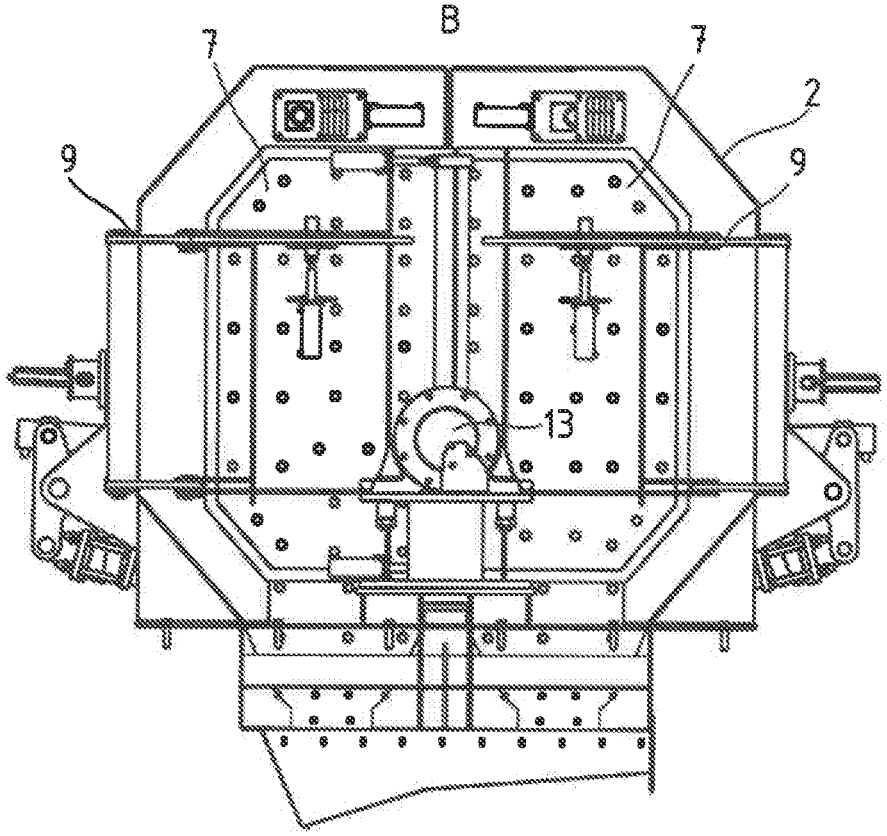
FIG. 2 shows the impact crusher of FIG. 1 in the lateral view (arrow B)
Figure 3:
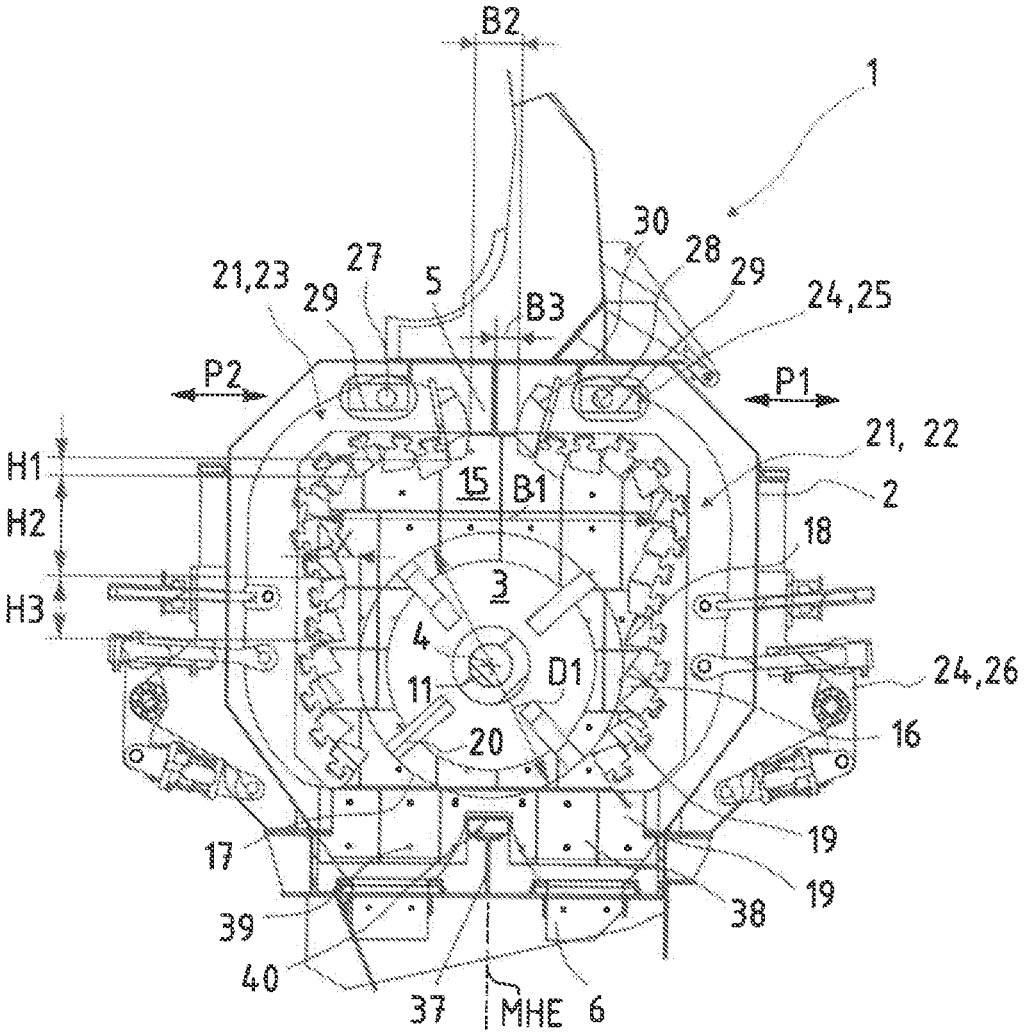
FIG. 3 shows a section along the line A-A through the impact crusher of FIG. 1 in a first operating position.

FIGS. 1 and 2 show two views of an impact crusher 1, once from above and once from the side. The impact crusher 1 possesses a crusher housing 2 which in the lateral view is substantially octagonal. The crusher housing 2 encloses a rotor (FIG. 3) having a horizontal rotation axis 4. The crusher housing 2 possesses an upper-side entry opening 5 for charging mineral material to be comminuted, said mineral material exiting an internal impact space of the crusher housing 2 by way of an exit opening 6 at the lower end of the crusher housing 2 (FIG. 3). A front side and a rear side of the crusher housing 2 can be opened for maintenance purposes. Bi-folding doors 7, 8 on a front side and a rear side of the crusher housing 2 by way of suspensions 9, 10 are mounted so as to be pivotabie on the crusher housing 2 such that access from both sides to the interior of the crusher housing 2 is possible for assembly works.

The rotor 3 possesses a rotor shaft 11 which is mounted in bearings 12, 13 outside the crusher housing 2. A drive pulley 14 for a belt drive, hi particular a V-belt drive, is situated so as to be adjacent to the upper bearing 12 in the image plane in FIG. 1. The drive pulley 14 possesses in particular a plurality of grooves so that a sufficient drive output can be transmitted to the rotor 3.

FIG. 3 in the sectional illustration along the line A-A of FIG. 1 shows the internal construction of the impact crusher 1 in a first operating position. The crusher housing 2 encloses the rotor 3 and delimits an impact space. The impact space is divided into an upper impact space 15 which is substantially, that is to say largely, above the rotor 3, and a lower impact-grinding space 16 in which the rotor 3 is situated. The direct region influenced by the rotor 3 is the crushing circle 17.

The upper impact space 15 is divided into three regions. An upper height region H1 is situated so as to be adjacent to the entry opening 5. A central height region H2 and finally a lower height region H3 adjoin said upper height region H1 toward the bottom in the direction of the rotor 3. The lower impact-grinding space 16 commences below a crushing edge 18. It can be seen on the right in the image plane of FIG. 3 that the crushing edge 18 is disposed so as to be very close to the crushing circle 17. The set spacing from the crushing circle 17 becomes even smaller in the direction toward the exit end and tapers off in a wedge-shaped manner. The crushing gap is situated on the right because the rotor in this operating position rotates in the clockwise direction. The crushing gap is very small because comparatively small material is to be crushed. The impact crusher in this position can be used for producing sand of high quality. The gap is a very large on the opposite side. No material is crushed here. The impact arm there is situated in the parking position.

The crushing edge 18 is situated on a wear member 19. For reasons of clarity, not all wear members 19 of the impact space are individually identified. In principle, the upper impact space 15 as well as the lower impact-grinding space 16 are cladded with wear members 19. The internal sides of the doors 7, 8 are also cladded with wear members 19; this can be seen by the cuboid plates having in each case two fastening points. The wear members 19 can have dissimilar contours but in principle are fastened so as to be replaceable on the doors, or in the peripheral region of the upper impact space 15 and of the lower impact-grinding space 16, respectively.

The rotor 3 in the case of this exemplary embodiment is equipped with four impact strips 20 which are disposed so as to be distributed uniformly across the circumference and which define the crushing circle 17.

An impact mechanism 21 which comprises two impact flanks 22, 23 that are configured so as to be mirror-symmetrical is situated within the crusher housing 2. The impact flanks 22, 23 are repositionable relative to the crusher housing 2. An adjustment installation 24 which per impact arm 22, 23 comprises one upper impact arm adjustment 25 for adapting the width B1 of the upper impact space 15 and of the entry opening 5 to a maximum charge size of the material to be comminuted, and one lower impact arm adjustment 26 for adapting the spacing (crushing gap) to the crushing circle 17 of the rotor 3 serves to this end. A linear displacement of the bearing points 27, 28 in the direction of the arrows P1, P2 that is to say in the horizontal direction, is is possible in the region of the upper impact arm adjustment 25. The bearing points 27, 28 are in each case guided in one gate guide 29. A pivoting movement about the bearing points 27, 28 can be performed when an adjustment is required at the upper and/or the lower end. On account thereof, the width B2 of the entry opening 5 can be set independently of the gap width in the lower impact-grinding space 16. The shape of the impact arms 22, 23 is designed in such a manner that a very large upper, wide impact space 15 is created in the region between the entry opening 5 on the rotor 3. On account thereof, an ideally free movement of the fraction be comminuted upon initial contact with the impact strip 20 on the rotor 3, or on the way back from the impact arms 22, 23 to the rotor 3 is enabled.

The contour of the upper impact space 15 and lower impact-grinding space 16 delimited by the impact arms 22, 23 can be a sequence of radii. The exact contour is determined by the impact faces of the wear members 19. The disposal of the wear members 19 leads to a polygonal, serrated shape.

The maximum width B1 of the central height region H2 of the upper impact space 15 is not only generally the maximum extent between the two impact arms 22, 23; the width B1 is moreover larger than the diameter D1 of the crushing circle 17. Consequently, there is a dimension identified by X which identifies the horizontal spacing between the outermost horizontal point of the crushing circle 17 and the outermost point of the contour of the impact arm 23 at the width B1. This dimension X is positive, independently of the position of the impact on 23. This means that the maximum width B1 in the central height region H2 is always larger than the diameter D1 of the crushing circle 17. For reasons of clarity, the dimension X is plotted on the opened impact arm 23. The dimension X is likewise positive on the opposite side on the other impact arm 21 having the crushing gap thereon.

The upper impact space 15 is configured so as to be concave on both sides. The material to be comminuted is propelled into the concave bulges. From there, the material bounces back and by way of the crushing edge 18 later falls into the crushing gap of the lower impact-grinding space 16.

The concave bulges are designed so as to be so large that there is a sufficient distance for propelling even comparatively large material effectively against the wear members 19 of the upper impact space 15 without following material being impeded and without impact energy being mitigated in an undesirable manner. This can significantly be traced back to the maximum width B1 being situated above the crushing circle 17 and even at a spacing from the crushing circle 17 of the rotor 3, in particular in the center +/−15% of the vertical spacing between the crushing edge 18 and the lower edge of the entry opening 5.

Figure 4:
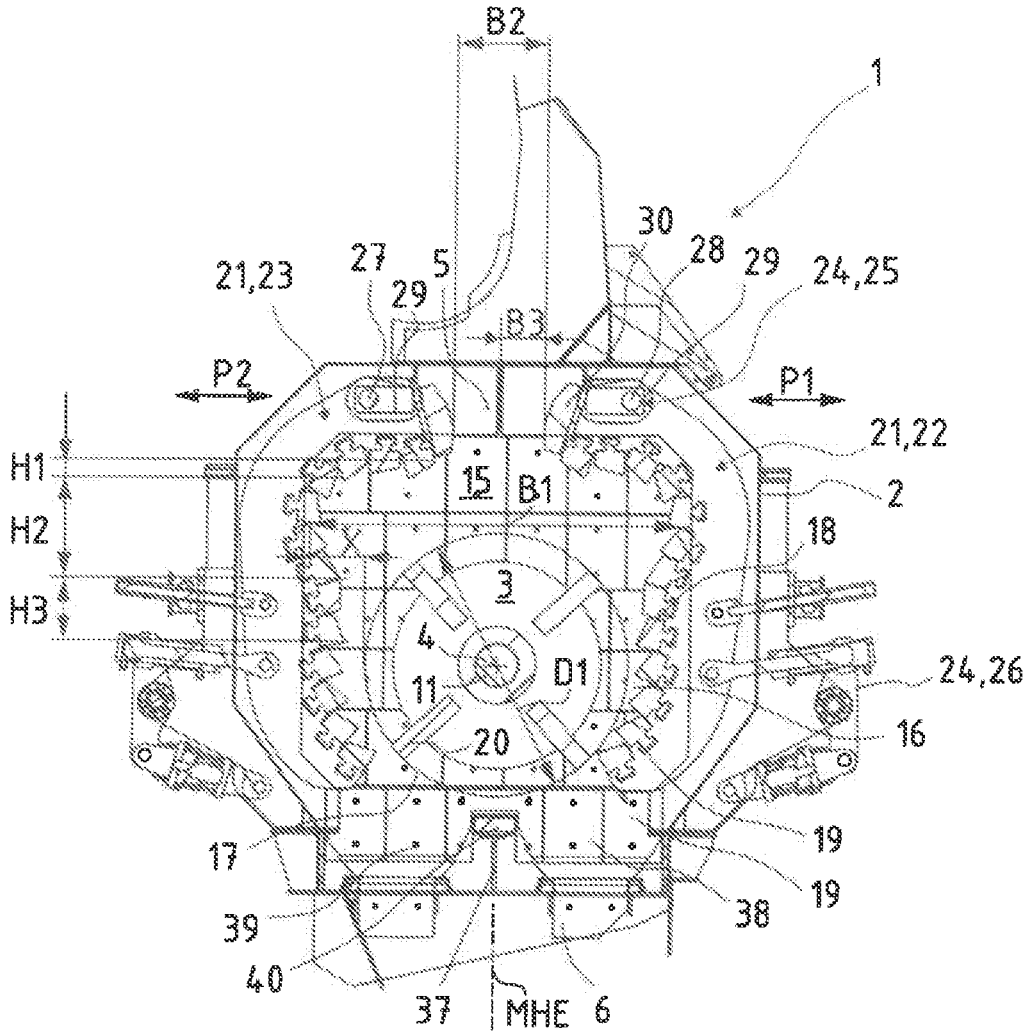
FIG. 4 shows a section along the line A-A through the impact crusher of FIG. 1 in a second operating position.

FIG. 3 shows a first operating state, wherein the disposal of the impact arms 22, 23 is not mirror-symmetrical since the left impact arm 23 in the image plane is repositioned farther toward the left, thus is opened wider, than the right impact arm 22 in the image plane, which is moved very close to the crushing circle 17. Accordingly, the spacing from the crushing circle 17 on the right in the image plane is substantially smaller than on the left in the image plane. The crushing gap in FIG. 3 for producing comparatively small fractions is already set so as to be very small in the region of the crushing edge 18. The crushing gap in FIG. 4 is set very large, wherein said crushing gap tapers off downward toward the exit end. On account of the positions of the impact arms 22, 23, the entry opening 5 once is set to the minimum (FIG. 3) and once is set to the maximum (FIG. 4).

In the reversed operation the respective impact arms 22, 23 are set in an exactly reversed manner. During the operation, one impact arm 22, 23 is always situated in a parking position (open position) and one impact arm 22, 23 is situated in an operating position for setting the crushing gap. In terms of the width of the entry opening it is irrelevant in which direction the impact crusher 1 is operated. The reverse setting of the impact arms 22, 23 changes the position of the crushing gap but not the width of the entry opening 5.

The lower impact-grinding space 16 is designed so as to be concave by virtue of the contour of the lower impact-grinding space 16 being adapted to the shape of the crushing circle 17. Conjointly with the upper impact space 15, two successive concave regions result so that the right contour of the impact arm 22 in the image plane is substantially B-shaped. Mirrored on the central vertical plane MHE, the mirror-symmetrically configured other impact arm 23 is accordingly likewise provided with a contour which suggests an mirrored letter B. The lower concave region is the lower impact-grinding space 16. The upper concave region is the upper impact space 15. The crushing edge 18 between these two concave regions is the transition between said two spaces.

FIG. 3 shows very clearly that the entry opening 5 is in principle disposed so as to be vertically above the rotor 3 and thus also vertically above the exit opening 6. In practical use, the entry opening is centrical, that is to say symmetrical, in relation to the central vertical plane. B3 identifies the spacing of an impact member 30 on the entry opening 5 from the central vertical plane MHE.

FIG. 4 shows a further potential position of the impact arms 22, 23 and therefore another operating position. The entry opening 5 is open to the maximum width. Coarser material can be received than in FIG. 3. By contrast to FIG. 3, the parking position of the left impact arm 23 has been adapted. The upper end of said left impact arm 23 at the entry opening 5 has been displaced to the maximum toward the left, just as the upper end of the right impact arm 22 has also been displaced to the maximum toward the right, thus has been opened. The entry opening 5 is therefore symmetrical in relation to the central vertical plane MHE.

The entry opening 5 is also symmetrical in relation to the central vertical plane MHE in FIG. 3. Material to be comminuted is always fed to the rotor 3 from vertically above. This means that the upper ends of the impact arms 22, 23 are set so as to be symmetrical, while the lower ends of the impact arms 22, 23 are set so as to be non-symmetrical because one of the impact arms 22, 23 is always situated in a parking position and the respective other impact arm 22, 23 is situated in an operating position. It is to be noted that the setting of the width and of the shape of the crushing gap is adjusted conjointly with the width B2 of the entry opening 5, specifically by a linear displacement in the region of the entry opening 5. When the wear members 19 in the impact-grinding space 16 wear out, the impact arms 22, 23 can still be readjusted somewhat, that is to say repositioned farther inward. The wear members 19 from the impact-grinding space 16 can be swapped with those in the upper impact space 15.

A separation wall 37 which divides the region between the exit opening 6 and the rotor 3 into two ducts 38, 39 which, depending on the rotation direction of the rotor 3, serve as an exit is disposed below the rotor 3 on the exit side. A wear protection element 40 on an end side 3 of the separation wall 37 that faces the rotor 3 protects the separation wall 37 against wear. The crushed material is decelerated. Said crush material jumps out to a lesser extent and does not jump upward in the direction toward the other impact arm which is situated in the parking position. A downstream conveyor belt is treated gently.

Figure 5:
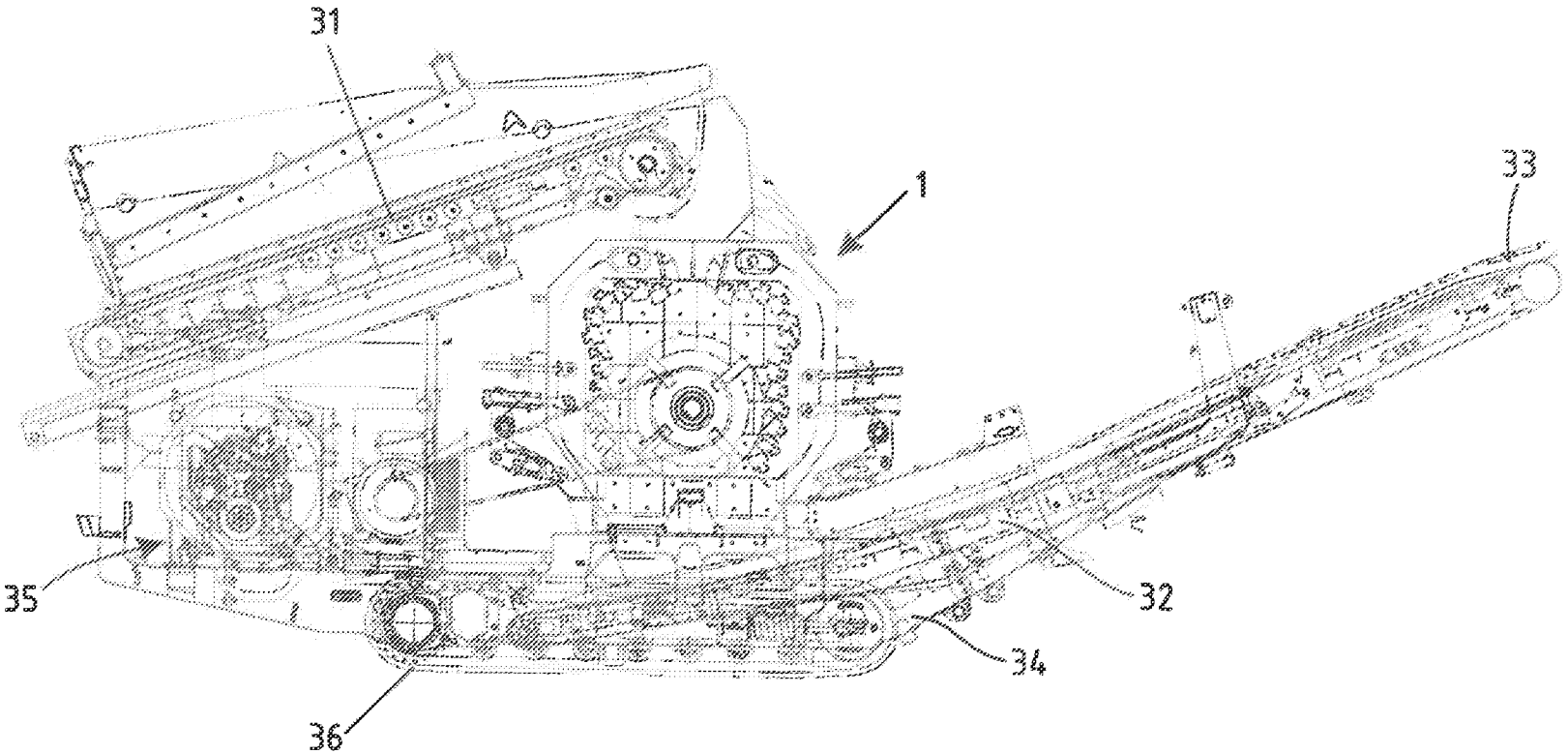
FIG. 5 shows a mobile impact crusher in a partially sectional manner.

FIG. 5 shows the impact crusher 1 in a mobile embodiment. The impact crusher 1 is provided with an infeed installation 31 by way of which the mineral material to be crushed is charged from above and by way of the entry opening 5 makes its way into the interior of the impact crusher 1. After crushing, the comminuted mineral material is delivered onto an outfeed installation 32 by way of which the material is fed to a drop-off end 33. The outfeed installation 32 is in particular a belt conveyor.

The impact crusher 1 together with the infeed installation 31 and the outfeed installation 33, conjointly with a drive 35 are situated on a frame 34. The frame 34 is moreover provided with a running gear 36 in the form of a tracked running gear. On account thereof, the impact crusher 1 according to the invention can negotiate the worksite and be moved to the correct position.

The invention claimed is:

1. An impact crusher for mineral material, comprising:

a crusher housing, said crusher housing having an upper-side entry opening for the mineral material to be comminuted;

a reversible rotor defining a horizontal rotation axis and configured for propelling mineral material against wear members in the crusher housing;

a drive for driving the rotor;

an impact mechanism delimiting an impact-grinding space for accommodating the rotor, said impact mechanism being adjustable relative to the crusher housing and relative to the rotor, an adjustment installation configured to set a spacing of the impact mechanism from the rotor; and an upper impact space adjoining a top of the impact-grinding space, said upper impact space having an upper height region that is below the upper-side entry opening of the crusher housing, a central height region that adjoins the upper height region, and a lower height region that is contiguous to a lower impact-grinding space, with each of the upper, central and lower height regions being defined by a horizontally measured internal width, wherein the central height region is a region having a largest internal width and at a widest location thereof, which is above a crushing circle of the rotor, has a maximum width which is larger than a diameter of the crushing circle of the rotor, wherein the adjustment installation includes an upper impact arm adjustment with bearing points linearly displaceable in a horizontal direction guided in gate guides for adapting a width of the upper impact space and a width of the upper-side entry opening of the crusher housing to a maximum charge size of the mineral material to be comminuted, and a lower impact arm adjustment for adjusting a spacing of the wear members in the lower impact-grinding space to a crushing circle of the rotor, and wherein the impact mechanism includes impact arms which extend into the upper impact space such that a width of the impact-grinding space is adjustable conjointly with the width of the upper impact space.

2. The impact crusher of claim 1, wherein the central height region of the upper impact space on both sides of a central vertical plane of the impact crusher is configured so as to be concave, and wherein the width of the upper impact space decreases toward the lower height region.

3. The impact crusher of claim 1, wherein the maximum width in the central height region is larger than a width of the lower impact-grinding space, measured at a height level of the rotation axis of the rotor.

4. The impact crusher of claim 1, wherein the lower height region of the upper impact space has a lower end configured as a crushing edge with a contour of the impact mechanism.

5. The impact crusher of claim 1, wherein the impact mechanism includes a left impact arm having wear members and a right impact arm having wear members, said left and right impact arms being configured so as to be mirror-symmetrical in relation to a central vertical plane of the impact crusher, wherein an internal contour of the left and right impact arms in the upper impact space and the impact-grinding space corresponds to a contour of letter B in terms of two successive concave arcs.

6. The impact crusher of claim 1, wherein the crusher housing has an internal impact space with an exit opening, and further comprising a separation wall disposed below the rotor and dividing the exit opening into two separate ducts.

7. The impact crusher of claim 6, further comprising:

an infeed installation to the upper-side entry opening of the crusher housing for the mineral material to be comminuted;

an outfeed installation for outfeeding comminuted mineral material from the exit opening to a drop-off end; and a frame on which the crusher housing, the infeed installation, the outfeed installation, and the drive are disposed.

8. The impact crusher of claim 7, further comprising a running gear disposed on the frame for mobility.

* * * * *